US012618583B2

(12) United States Patent
Plasser et al.

(10) Patent No.: US 12,618,583 B2
(45) **Date of Patent: *May 5, 2026**

(54) METHOD, SYSTEM AND COMPUTER PROGRAM PRODUCT FOR CONTROLLING AN HVAC SYSTEM

(71) Applicant: BELIMO Holding AG, Hinwil (CH)

(72) Inventors: Markus Plasser, Hinwil (CH); Christian Luchsinger, Hinwil (CH)

(73) Assignee: BELIMO HOLDING AG, Hinwil (CH)

( * ) Notice: Subject to any disclaimer, the term of this patent is extended or adjusted under 35 U.S.C. 154(b) by 334 days.

This patent is subject to a terminal disclaimer.

(21) Appl. No.: 18/336,291

(22) Filed: Jun. 16, 2023

(65) Prior Publication Data

US 2024/0044543 A1 Feb. 8, 2024

(30) Foreign Application Priority Data

Aug. 8, 2022 (CH) ..... 000934/2022

(51) Int. Cl.
*F24F 11/75* (2018.01)
*F24F 110/40* (2018.01)

(52) U.S. Cl.
CPC ..... *F24F 11/75* (2018.01); *F24F 2110/40* (2018.01)

(58) Field of Classification Search
CPC ..... F24F 11/75; F24F 2110/40
USPC ..... 700/276
See application file for complete search history.

(56) References Cited

U.S. PATENT DOCUMENTS 7,832,465 B2 * 11/2010 Zou ..... F24F 3/0442 700/277
2010/0307733 A1 * 12/2010 Karamanos ..... F24F 11/84 165/254
2016/0033158 A1 * 2/2016 Lu ..... F24F 3/08 165/218
2016/0169549 A1 * 6/2016 Qin ..... F24F 3/06 165/218

(Continued)

FOREIGN PATENT DOCUMENTS

DE 10-2010-022763 A1 12/2011
WO 2014/165497 A1 10/2014

OTHER PUBLICATIONS

Swiss Search Report of CH000934/2022 dated Nov. 25, 2022.
The Extended European Search Report of EP22200387.3 dated May 2, 2023.

*Primary Examiner* — Md Azad
(74) *Attorney, Agent, or Firm* — Sughrue Mion, PLLC

(57) ABSTRACT

A method of controlling a Heating, Ventilating and Air Conditioning (HVAC) system including a fluid transportation network that includes one or more network sections, each network section being connected to a fluid transportation circuit through respective supply lines and return lines, each network section including plural parallel zones, includes arranging a pressure regulating device in the supply lines and/or respective return lines of the network sections, arranging flow regulating devices in the zones of the network sections, measuring a remote differential pressure of the fluid in a first zone of the plurality of zones of each of the network sections, and controlling, by a controller, the pressure regulating devices of each network section to maintain the measured remote differential pressure within a specified differential pressure range.

16 Claims, 12 Drawing Sheets

(56) References Cited

U.S. PATENT DOCUMENTS

| | | | | |
|---|---|---|---|---|
| 2019/0107292 | A1* | 4/2019 | Mischler | F24D 10/003 |
| 2023/0243542 | A1* | 8/2023 | Chakraborty | F24F 11/65 454/229 |

* cited by examiner

METHOD, SYSTEM AND COMPUTER PROGRAM PRODUCT FOR CONTROLLING AN HVAC SYSTEM

CROSS-REFERENCE TO RELATED APPLICATION

This Application is based on and claims priority from Swiss Application No. CH000934/2022, filed on Aug. 8, 2022, the contents of which being herein incorporate by reference in its entirety.

FIELD OF THE INVENTION

The present invention relates to a method of controlling a Heating, Ventilating and Air Conditioning HVAC system comprising a fluid transportation network having one or more network sections, each comprising a plurality of parallel zones accommodating a thermal energy exchanger. The present invention further relates to a Heating, Ventilating and Air Conditioning HVAC system comprising a fluid transportation network having one or more network sections, each comprising a plurality of parallel zones accommodating a thermal energy exchanger. The present invention further relates to a computer program product for a controller of an HVAC system.

BACKGROUND OF THE INVENTION

In the field of Heating, Ventilating and Air Conditioning, HVAC systems typically comprise a fluid transportation network comprising thermal energy exchanger(s) arranged such as to be able to transfer thermal energy to/extract thermal energy from the environment to be controlled (referred to hereafter as controlled environment) by means of a fluid circulating in said fluid transportation network. By regulating the flow of fluid through a thermal energy exchanger of an HVAC system, it is possible to adjust the amount of energy (respectively the amount of energy per unit of time, power) transferred by the thermal energy exchanger. For example, the energy exchange or the power transfer, correspondingly, is adjusted by regulating the amount of energy delivered to/extracted from the thermal energy exchanger to heat or cool a room in a building, or by regulating the amount of energy delivered to a chiller for cooling purposes. While the fluid transport through the fluid transportation circuit of the HVAC system is driven by one or more pumps or fans, the flow is typically regulated by varying the orifice (opening) or position of valves. In order to be able to regulate the flow of fluid to/from the thermal energy exchanger and hence the amount of thermal energy transferred, thermal energy exchanger(s) are connected to the fluid transportation network via one or more flow regulating devices such as valves and dampers. The regulating devices are mechanically controlled by HVAC field devices, in particular actuators, including motorized HVAC actuators coupled to the regulating device(s). In the field of HVAC, HVAC actuators typically comprise an electric motor, drivingly coupled (through gears and/or other mechanical coupling), to the actuated part, i.e. the regulating device. HVAC actuators are electrically controlled by HVAC controllers, in particular an electronic circuit thereof. In addition, various sensors are used to measure environmental variables such as humidity, temperature, $CO_2$ or dust particle levels. Furthermore, HVAC sensors are used to determine operational parameters of various elements of an HVAC system, such as an actuated position of an actuated part, the operational state of an HVAC actuator.

Fluid transport networks often comprise one or more network sections, each network section being connected to a fluid transportation circuit through respective supply line(s) and return line(s), each network section comprising a plurality of parallel zones each comprising a consumer, such as a thermal energy exchanger. However, the consumers typically have different designs, meaning that they have different geometries of its flow chambers—and have different and/or varying flow volumes and/or throughput. In order to undertake a balanced and/or compensated distribution of the fluids to the consumers in such fluid transport networks and to control a fluid flow such as to control its temperature, the consumers are each configured with a compensation- or balancing organ, for example a flow regulating device, particularly a valve (for liquids) or a damper (for gaseous fluids), which can regulate the flow rate through the respective consumer at different valve/damper opening positions.

Due to different characteristics of the consumers of the different sections of fluid transportation network and/or of the flow regulating devices in the various zones, there are different requirements of operational parameters to be met for each of the parallel zones. A common requirement to be met for each of the parallel zones within a network section of a fluid transportation network is the fluid pressure being maintained within a specified differential pressure range. The specified differential pressure range to be maintained is defined by an operational range of the regulating device(s), the thermal energy consumer and/or any other element within the respective parallel zone, in particular an optimal operational range. For example, pressure invariant regulating valves have a specific pressure range within which they are capable of maintaining a specified flowrate irrespective of the fluid pressure. Hence, optimally, the fluid pressure in a parallel zone comprising such a pressure invariant regulating valve is to be maintained within the specific pressure range within which they are capable of maintaining a specified flowrate irrespective of the fluid pressure.

Alternatively, or additionally, various components of a fluid transportation network have specific operational pressure ranges, or optimal operational pressure ranges, these ranges being determined such as to avoid the turbulences leading to excessive noise and/or wear, such as turbulences due to cavitation of the fluid.

In prior art HVAC systems, pressure regulating device(s) of a plurality of zones and/or of a network section are controlled based on a differential pressure measured between supply and return line of the network section. However, measuring a differential pressure between supply and return line of the network section is not sufficient for ensuring that the pressure in each zone of the network section is maintained at a specified differential pressure range (value). In order to address this problem, according to prior art fluid transport networks, a separate pressure sensor is placed in each of the parallel zones of a network section to ensure that the differential pressure is maintained within a specified differential pressure range in each of the parallel zones. As a result, a great degree of complexity is particularly inherent in the installation; operation and/or maintenance process, leading to an increase of the costs of such prior art HVAC systems.

SUMMARY OF THE INVENTION

It is an object of this invention to provide a method, an HVAC system and computer program product for controlling an HVAC system having a fluid transportation network—comprising one or more network sections each comprising a plurality of parallel zones—which method does not have at least some of the disadvantages of the prior art. In particular, it is an object of this invention to provide a method of controlling an HVAC system comprising a fluid transportation network ensuring operation of each of the plurality of parallel zones within a specified differential pressure range with a reduced complexity, in particular with a reduced number of pressure sensors.

In the context of the present application, a fluid transportation network comprises one or more network sections, each network section being connected to a fluid transportation circuit through respective supply line(s) and return line(s), each network section comprising a plurality of parallel zones. According to embodiments, one or more of the parallel zones comprise a thermal energy consumer, such as a thermal energy exchanger. Typically, each fluid transportation circuit comprises a fluid flow generator such as a pump for liquid fluids (such as water) or a fan for gaseous fluids (such as air).

According to the present disclosure, these objects are addressed by the features of the independent claims. In addition, further advantageous embodiments follow from the dependent claims and the description.

In a first step of the method of controlling an HVAC system comprising a fluid transportation network, a pressure regulating device is arranged in the supply lines and/or respective return lines of each of the network sections. In particular, the pressure regulating device comprises a control valve or a control damper for regulating the pressure in the supply lines and/or respective return lines by varying an opening of an orifice. Alternatively, the pressure regulating device comprises or is connectable to a fluid flow generator, such as a pump or fan, the pressure regulating device being configured to regulate the pressure by adjustment of a power level of the pump or a fan speed of the fan.

In order to be able to independently regulate the flow rate of the fluid in the zones, flow regulating devices are arranged in the zones of the network sections. In order to maintain a set flowrate irrespective of a pressure within the respective zone, according to further embodiments, pressure-invariant regulating device(s) are arranged in one or more of the zones, configured to implement the respective zones as pressure independent branches of the respective network section.

In a further step of the method of controlling an HVAC system comprising a fluid transportation network according to the present disclosure, a remote differential pressure of the fluid in a first zone of the plurality of zones of each of the network sections is measured, in particular using a pressure sensor, such as a differential pressure sensor configured and arranged to measure a difference in fluid pressure at two different points of the fluid transportation network. As used herein, the term "differential pressure" refers to a pressure difference (such as a pressure drop) between two distinct locations of the fluid transportation network, such as pressure difference between the supply line and return line of a network section or a pressure difference between the zone supply line and zone return line of a zone.

The pressure regulating device(s) of each of the network sections are then controlled, by a controller, to maintain the measured remote differential pressure within a specified differential pressure range, such as by generating control signals for an actuator drivingly connected to the pressure regulating device(s) to regulate an opening of an orifice for the passage of the fluid. In particular, the pressure regulating device(s) are controlled to reach, respectively maintain a specified differential pressure setpoint.

In order to ensure desired operation of flow regulating devices, the specified differential pressure range is defined—according to embodiments—in accordance with device specifications of the flow regulating device(s). In particular, the specified differential pressure range is defined in accordance with specific operational pressure ranges/setpoints, or optimal operational pressure ranges/setpoints determined such as to avoid turbulences leading to excessive noise and/or wear of the flow regulating devices, such as turbulences due to cavitation of the fluid.

According to embodiments, the pressure sensor for the measurement of the remote differential pressure is purposively arranged in a specific zone in order to allow operation of each of the parallel zones within the specified differential pressure range.

In the following, when referring to one or more of the zones having a highest fluid resistance, the fluid resistance of the respective network section leading to the flow regulating device of the respective zone is referred to, including the fluid resistance of the respective supply line(s). According to embodiments, the fluid resistance of a zone further encompasses the fluid resistance of the respective network section leading from the flow regulating device of the respective zone, including the fluid resistance of the respective return line(s). According to embodiments, the fluid resistance of a zone further encompasses the fluid resistance of a thermal energy exchanger arranged in the respective zone.

In a first use case when operation of each of the parallel zones is to be kept above a minimum differential pressure, the pressure sensor for measurement of the remote differential pressure is arranged in a first zone (of the plurality of parallel zones) having a highest fluid resistance amongst the plurality of zones within the respective network section of the one or more network sections. Typically, but not necessarily, the zone with highest fluid resistance is located the furthest away (in the direction of fluid flow) from the fluid supply line of the respective network section. Such an embodiment is advantageous as it allows operation of each of the parallel zones within the specified differential pressure range without having to arrange a pressure sensor in each of the zones, based on the principle that ensuring a minimum differential pressure in the zone with the highest fluid resistance inadvertently leads to a differential pressure in any other zone of the respective network section equal to or higher than the differential pressure in the zone with the highest fluid resistance.

The first zone with the highest fluid resistance amongst the plurality of zones may be determined based on the fluid resistance of each of the plurality of zones within the respective network section.

According to embodiments, the fluid resistance of the zones within the respective network section are determined mathematically based on geometries of the respective zones and/or of the respective supply and/or return line(s). Alternatively, or additionally, the fluid resistance of the zones within the respective network section are determined by setting one or more of the flow regulating devices arranged in one or more of the zones to their respective fully open setting and measuring a zone pressure in each of the plurality of zones for determining the first zone with highest fluid resistance amongst the plurality of zones within the respective network section. Alternatively, or additionally, the fluid resistance of the zones within the respective network section are determined by successively closing flow regulating devices in all but one selected zone of the plurality of parallel zones of the network sections to determine the fluid pressure in the selected zone. By repeating the process of closing off fluid flow in every zone except the selected zone, the fluid pressure measured at any point (in the respective network section) successively provides an indication of the relative fluid resistance between the plurality of zones, allowing one to determine the zone with the highest fluid resistance.

In a further use case when, in addition to maintaining the measured remote differential pressure within the specified differential pressure range, operation of each of the parallel zones is to be kept below a maximum differential pressure, an additional pressure sensor is arranged for the measurement of the differential pressure between the supply line and the return line of the network section(s). In particular, the additional pressure sensor is arranged in the proximity of the pressure regulating device of the respective network section. Such an embodiment is advantageous as it allows operation of each of the parallel zones within the specified differential pressure range without having to arrange a pressure sensor in each of the zones and, in addition, ensure that a maximum differential pressure is not exceeded in any of the parallel zones, based on the principle that limiting the differential pressure to a maximum value inadvertently leads to a differential pressure in any other zone of the respective network section equal to or lower than the differential pressure measured between the supply line and the return line of the network section(s).

In the context of the present disclosure, the term highest with respect to fluid resistance is to be interpreted as an absolute highest value including with a specific margin of error. Alternatively in the context of the present disclosure, the term highest with respect to fluid resistance is to be interpreted to further encompass values of fluid resistance above a specific threshold resistance.

According to a first embodiment, the pressure sensor(s) for the measurement of a pressure within one or more of the plurality of zones is arranged such as to measure a differential pressure between a zone supply line and a zone return line of the respective zone.

Alternatively, or additionally, the pressure sensor(s) for the measurement of a pressure within one or more of the plurality of zones is arranged to measure a differential pressure over the flow regulating device in the respective zone, in particular by arranging probes of the pressure sensor(s) in the proximity of an input port and an output port of the flow regulating device. Such embodiments are advantageous as it allows defining the specified differential pressure range as essentially equal to an operational differential pressure of the respective flow regulating device, a value which is for example part of the manufacturer's specifications of a flow regulating device.

It is a further object of embodiments disclosed herein to further ensure a minimum fluid flow in the supply line(s) of a network section, from which the fluid into the parallel zones is branched off. Ensuring a minimum fluid flow in the supply line(s) of a network section is desirable in order to prevent on otherwise long time delay before beginning of a flow of fluid in the supply line(s) after opening of a previously closed-off flow regulating device in the zone having the highest fluid resistance. The object of ensuring a minimum fluid flow in the supply line(s) of a network section is addressed by arranging a bypass flow regulating device at a location of highest fluid resistance within each network section; and controlling, by the controller, the bypass flow regulating device such as to maintain the section flow rate above a minimum flow rate, in particular by fully opening the bypass flow regulating device.

It is a further object of embodiments disclosed herein to further ensure a minimum fluid flow throughout all zones of a network section, for example to avoid freezing of the fluid. This object is addressed by measuring section flow rate(s) in the supply line(s) or respective return line(s) of one or more network sections; and controlling, by the controller, the flow regulating device in the first zone—having a highest fluid resistance amongst the plurality of zones—such as to maintain the section flow rate above a minimum flow range. The object of ensuring a minimum fluid flow throughout all zones is addressed based on the principle that by ensuring a minimum flow rate in the first zone of highest fluid resistance, it is inadvertently ensured that the flow rate in any other zone is also above the minimum flow rate. Alternatively, or additionally, the object of ensuring a minimum fluid flow throughout all zones is addressed by arranging a bypass flow regulating device at a location of highest fluid resistance within each network section; and controlling, by the controller, the bypass flow regulating device such as to maintain the section flow rate above a minimum flow rate, in particular by fully opening the bypass flow regulating device. In this way, it is ensured that each zone operates in the specified differential pressure range and at the same time it ensured that a minimum flow of fluid flows through the network section.

It is a further object of embodiments disclosed herein to maintain the remote differential pressure within a specified differential pressure range even if the flow regulating device in the first zone (having a highest fluid resistance) is closed off (or almost closed off). This object is addressed, according to an embodiment, by compensating the specified differential pressure range by a pressure compensation value if a current position post of the flow regulating device in the first zone is below a minimum opening threshold. According to an embodiment, the pressure compensation value is determined based on an estimated differential pressure in a second zone having a second highest fluid resistance (after the first zone) amongst the plurality of zones within the respective network section.

According to embodiments, the minimum flow rate is adjusted in accordance with a fluid temperature measured at the respective supply line(s) and/or return line(s) of each network section.

It is a further object of embodiments disclosed herein to operate fluid flow generator(s) of the fluid transportation circuit(s) efficiently. This object is addressed by determining current positions of the flow regulating device of each of the zones (at a given time) and controlling, by the controller, a power level of fluid flow generator(s) such as a pumping power of pump(s) of the fluid transportation circuit in accordance with the positions. According to embodiments, a currently most open position and/or currently least open position amongst the current positions of the flow regulating devices of each of the zones are determined. Based thereon, the power level of the fluid flow generator(s) is reduced if the currently most open position is below a lower opening limit. In other words, if even the currently most open flow regulating device of any zone is closed (or closed beyond a lower opening limit), then the power level of the fluid flow generator(s) is reduced.

Alternatively, or additionally, the power level of the fluid flow generator(s) is increased if the currently least open position exceeds an upper opening limit. In other words, if even the currently least open flow regulating device of any zone is fully open (or open beyond an upper opening limit), then this is indication of a demand for higher fluid flow and hence the power level of the fluid flow generator(s) is increased.

It is an object of further embodiments to address situations when one of the zones, comprising the regulating device with the currently most open position is fluidically isolated from the rest of the network section—i.e. due to the zone being manually closed off. This object is addressed, according to further embodiments, by arranging zone flow rate sensors in each of the zones of the network sections for measuring an actual flow rate through the respective zone. Based thereon, current positions of the flow regulating device(s) arranged in zone(s) where the actual flow rate is below a flow rate threshold are disregarded from determining the currently most open position. In other words, zone(s) are disregarded where the flow rate is actually determined not by the current positions of the flow regulating device but by other factors, such as the zone being otherwise (at least partially) closed-off. Otherwise, the power level of the fluid flow generator(s) would be erroneously increased under a false assumption that the fluid pressure is insufficient despite the most open position. Instead, the fluid pressure would actually be sufficient if the zone with the most open position would not be closed-off. As long as the zone with the currently most open position is closed-off, an increase of the power level of the fluid flow generator(s) would have no effect.

It is an object of further embodiments to allow a zone to be alternatively coupled to two fluid transportation circuits, such as a first fluid transportation circuit for supplying thermal energy (heating) or to a second fluid transportation circuit for extracting thermal energy (cooling). This object is addressed, according to embodiments, in that one or more of the flow regulating device(s) comprise six-way valve(s) configured to couple a respective zone alternatively to a first fluid transportation circuit for heating or to a second fluid transportation circuit for cooling, and to regulate the flow of fluid from the first or second fluid transportation circuit, respectively, through the zone. The six-way valve(s) each comprise a first fluid input port, a second fluid input port, a fluid output port, a fluid return input port, a first fluid return output port and a second fluid return output port. The first fluid input port and the first fluid return output port are connectable to a supply line respectively a return line of a first fluid transportation circuit while the second fluid input port and the second fluid return output port are connectable to a second supply line respectively a second return line of a second transportation circuit.

The above-identified objects are also addressed by an HVAC system comprising a fluid transportation network having one or more network sections, each network section being connected to a fluid transportation circuit through respective supply line(s) and return line(s), each network section comprising a plurality of parallel zones; a flow regulating device arranged in each of the zones of the network sections; a pressure regulating device arranged in the supply lines and/or respective return lines of each of the network sections; and a controller, wherein the HVAC system configured to carry out the method of controlling an HVAC system comprising a fluid transportation network according to any one of the embodiments disclosed herein.

The above-identified object(s) are also addressed by a computer program product comprising instructions, which, when carried out by a controller of an HVAC system, causes the HVAC system to carry out the method of controlling an HVAC system comprising a fluid transportation network according to any one of the embodiments disclosed herein.

BRIEF DESCRIPTION OF THE DRAWINGS

The herein described disclosure will be more fully understood from the detailed description given herein below and the accompanying drawings which should not be considered limiting to the disclosure described in the appended claims. The drawings which show:

DETAILED DESCRIPTION

Figure 1:
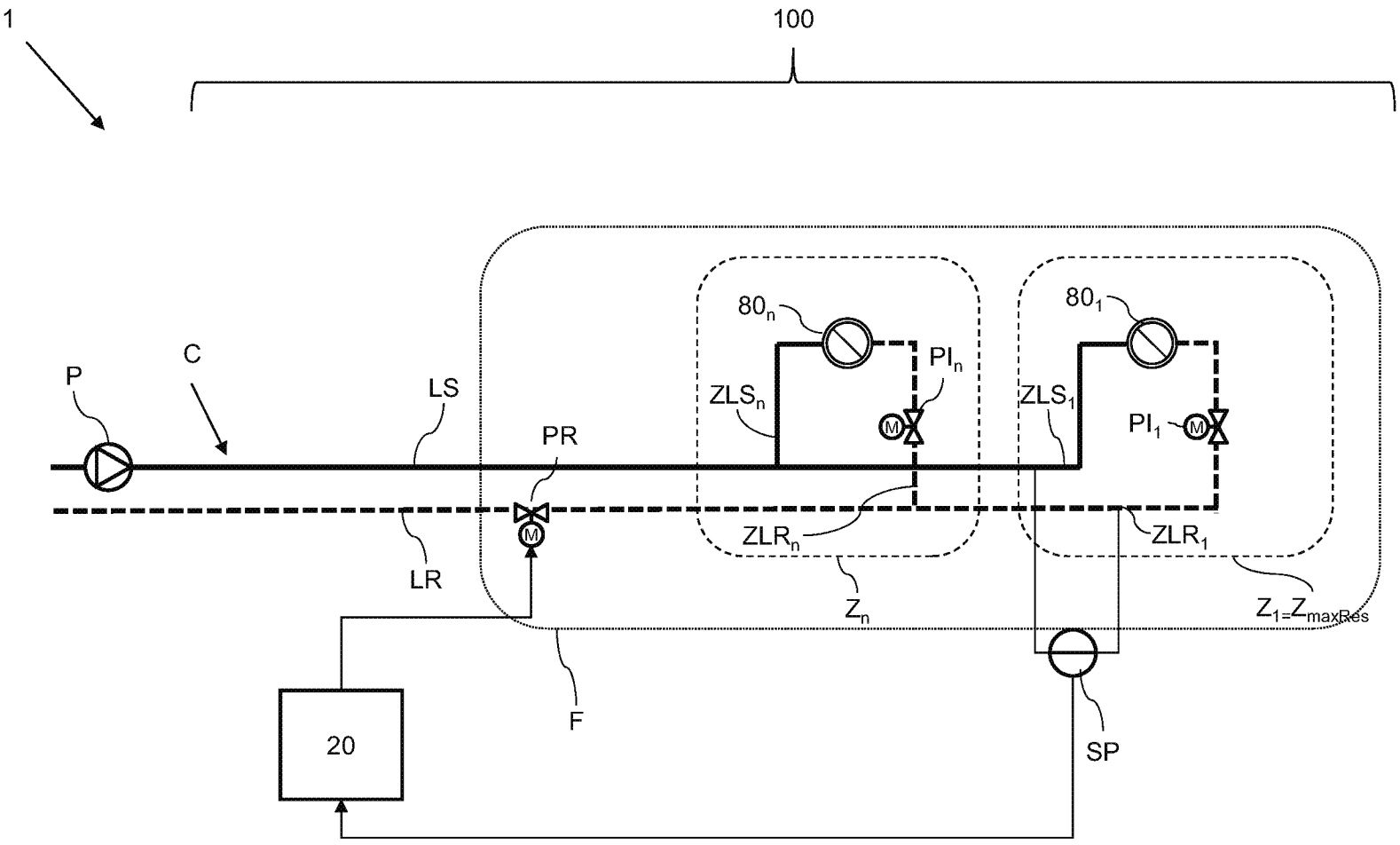
FIG. 1: a highly schematic block diagram of a first embodiment of an HVAC system according to the present disclosure.

Reference will now be made in detail to certain embodiments, examples of which are illustrated in the accompanying drawings, in which some, but not all features are shown. Indeed, embodiments disclosed herein may be embodied in many different forms and should not be construed as limited to the embodiments set forth herein; rather, these embodiments are provided so that this disclosure will satisfy applicable legal requirements. Whenever possible, like reference numbers will be used to refer to like components or parts. Reference numerals are indexed in case of a plurality of like components. For example an index $_{1\text{-}n}$ or $_{a\text{-}z}$ is used to refer to any one of a plurality of components ranging from 1 to n, or from a to z. When any one of a plurality of indexed components is referred to explicitly, the same component is referred to by its index and also a specific identifier. For example, a first zone is labeled by its index $Z_1$ as well as $Z_{maxRes}$ due to the fact that it is the zone with the highest fluid resistance.

FIGS. 1, 2, 4, 6, 9 and 10 (in the following referred to as "all block diagrams") each show highly schematic block diagrams of embodiments of an HVAC system 1 according to the present disclosure. In the figures, a fluid transportation network 100, e.g. a hydraulic or hydronic network, either comprises a single network section F (in FIGS. 1, 2, 4 and 6) or a plurality of network sections $F_{a\text{-}z}$ (in FIG. 9). Each network section F, $F_{a\text{-}z}$ in turn comprises a plurality of parallel zones $Z_{1\text{-}n}$ respectively $Z_{a\text{-}z,1\text{-}n}$. A controller 20 is communicatively coupled to sensors and actuated devices within the HVAC system 1 in order to gain measured values and control actuated devices, i.e. regulate the HVAC system 1. The controller 20 may be a separate device, a plurality of devices and/or implemented in one or more HVAC field devices of the HVAC system 1, such as in the flow regulating device(s) $PI_{1\text{-}n}$, $P_{a\text{-}z,1\text{-}n}$, pressure regulating device(s) PR, $PR_{a\text{-}z}$, and/or pressure sensor SP, $SP_{a\text{-}z}$, $SP_H$, $SP_C$, section flow sensor(s) SF, $SF_{a\text{-}z}$.

Figure 6:
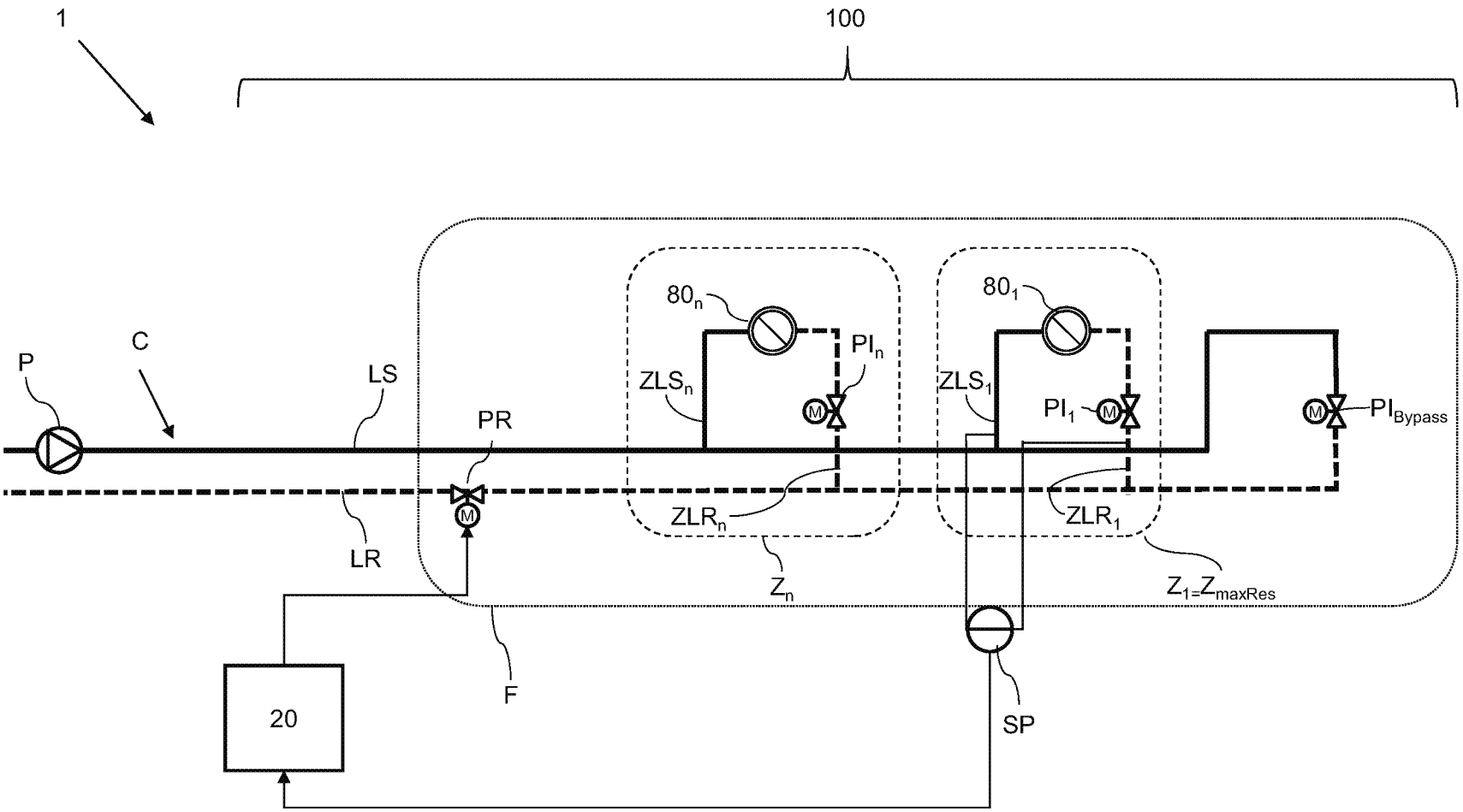
FIG. 6: a highly schematic block diagram of a further embodiment of an HVAC system according to the present disclosure, further comprising a bypass flow regulating device at a location of highest fluid resistance within each network section.

According to embodiments disclosed herein, sensors within the HVAC system 1 can comprise pressure sensors SP, $SP_{a\text{-}z}$, $SP_H$, $SP_C$ (in all block diagrams) and flow sensors SF, $SF_{a\text{-}z}$ (in FIGS. 4 and 9), and actuated devices can comprise pressure regulating devices PR, $PR_{a\text{-}z}$, (in all block diagrams), flow regulating devices $PI_{1\text{-}n}$, $PI_{a\text{-}z,1\text{-}n}$ (in all block diagrams), a fluid flow generator P (in all block diagrams) such as a pump or fan and bypass flow regulating devices $PI_{Bypass}$, $PI_{Bypass,\ a\text{-}z}$ (in FIG. 6).

Figure 2:
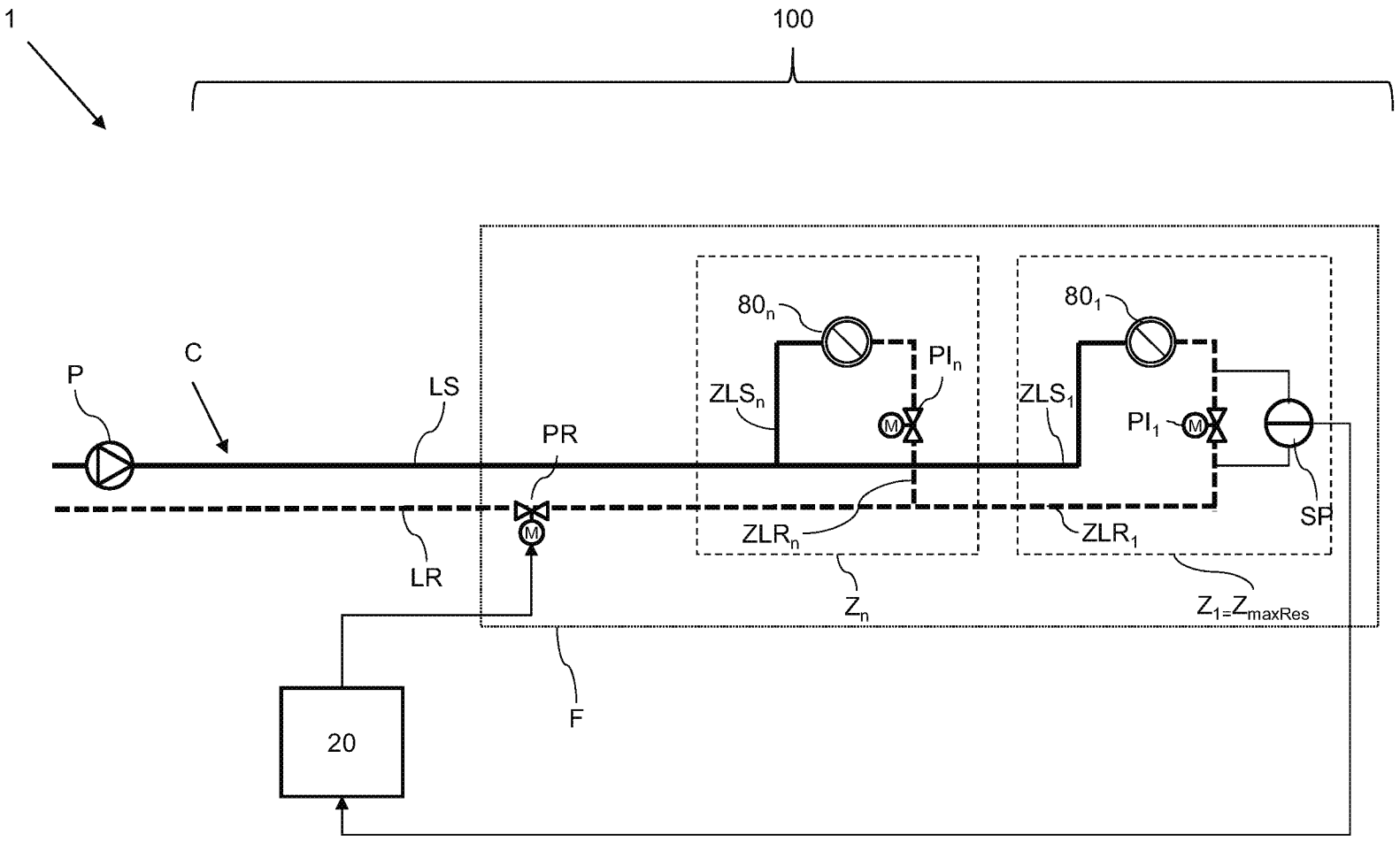
FIG. 2: a highly schematic block diagram of a further embodiment of an HVAC system according to the present disclosure, wherein the pressure sensor(s) for the measurement of a pressure within the respective zone is arranged to measure a differential pressure between the zone supply line and the zone return line of the respective zone.

The following sections describe the embodiment of FIGS. 1 and 2 having a single network section F in the fluid transportation network 100. FIGS. 1 and 2 show a network section F connected to a fluid transportation circuit C through a supply line LS and a return line LR. A pressure regulating device PR is arranged in the return line LR of the network section F. While not shown in the figures, alternatively or additionally, the pressure regulating device PR might also be arranged in the supply line LS. The pressure regulating device PR comprises a control valve for regulating the pressure in the return line LR by varying an opening of an orifice. While not shown on the figures, the valves of the pressure regulating device PR are actuated by an actuator, typically comprising an electric motor drivingly connected to a shaft of a valve element for adjusting a position. Alternatively, or additionally, the pressure regulating device PR is connectable to a fluid flow generator P (a pump in case of a liquid fluid), the pressure regulating device PR being configured to regulate the pressure by adjustment of a power level of the pump.

The network section F comprises a plurality of parallel zones $Z_{1\text{-}n}$. As illustrated schematically in FIGS. 1 and 2, each of the zones $Z_{1\text{-}n}$ is connected to the supply line LS and the return line LR via the zone supply line $ZLS_{1\text{-}n}$ respectively the zone return line $ZLR_{1\text{-}n}$ and comprises one or more thermal energy exchangers $\mathbf{80}_{1\text{-}n}$, e.g. heat exchangers for heating the zone $Z_{1\text{-}n}$ or chillers for cooling the zone $Z_{1\text{-}n}$. In order to be able to independently regulate the flow rate $\phi_{1\text{-}n}$ of the fluid in the zones $Z_{1\text{-}n}$, flow regulating devices $PI_{1\text{-}n}$ are arranged in the zones $Z_{1\text{-}n}$. In the embodiments depicted in the figures, the flow regulating devices $PI_{1\text{-}n}$ comprise flow regulating valves configured to regulate the fluid flow by varying an opening of an orifice. While not shown in the figures, the valves of the flow regulating devices $PI_{1\text{-}n}$ are actuated by an actuator, typically comprising an electric motor drivingly connected to a shaft of a valve element for adjusting a valve position of the flow regulating device.

The HVAC system 1 further comprises a pressure sensor SP configured and arranged for measurement of the remote differential pressure $dp_{Rem}$ in the first zone $Z_1=Z_{maxRes}$, the first zone $Z_{maxRes}$, having a highest fluid resistance amongst the plurality of zones $Z_{1\text{-}n}$, within the respective network section F, of the one or more network sections F.

In the first embodiment shown in FIG. 1, the pressure sensor(s) SP for the measurement of a pressure within the respective zone is arranged to measure a differential pressure between the zone supply line $ZLS_{1\text{-}n}$ and the zone return line $ZLR_{1\text{-}n}$ of the respective zone $Z_{1\text{-}n}$.

FIG. 2 shows a highly schematic block diagram of a variant of the first embodiment of an HVAC system according to the present disclosure, wherein the pressure sensor SP is arranged—in the first zone $Z_1=Z_{maxRes}$ downstream from the thermal energy exchanger $\mathbf{80}_1$ to measure a differential pressure over the flow regulating device $PI_1$ As shown in FIGS. 1 and 2, the pressure sensor SP for measurement of the remote differential pressure $dp_{Rem}$ is arranged in the first zone $Z_{maxRes}$, the first zone $Z_{maxRes}$ having a highest fluid resistance amongst the plurality of zones $Z_{1\text{-}n}$ within the respective network section F. In the depicted figures, the zone with the highest fluid resistance amongst the plurality of zones $Z_{1\text{-}n}$ is the first zone $Z_{maxRes}$ situated the furthest downstream from the supply line LS of the respective network section F. Nevertheless, the zone with the highest fluid resistance may be located elsewhere, depending on the geometry of the network section F.

Figure 3:
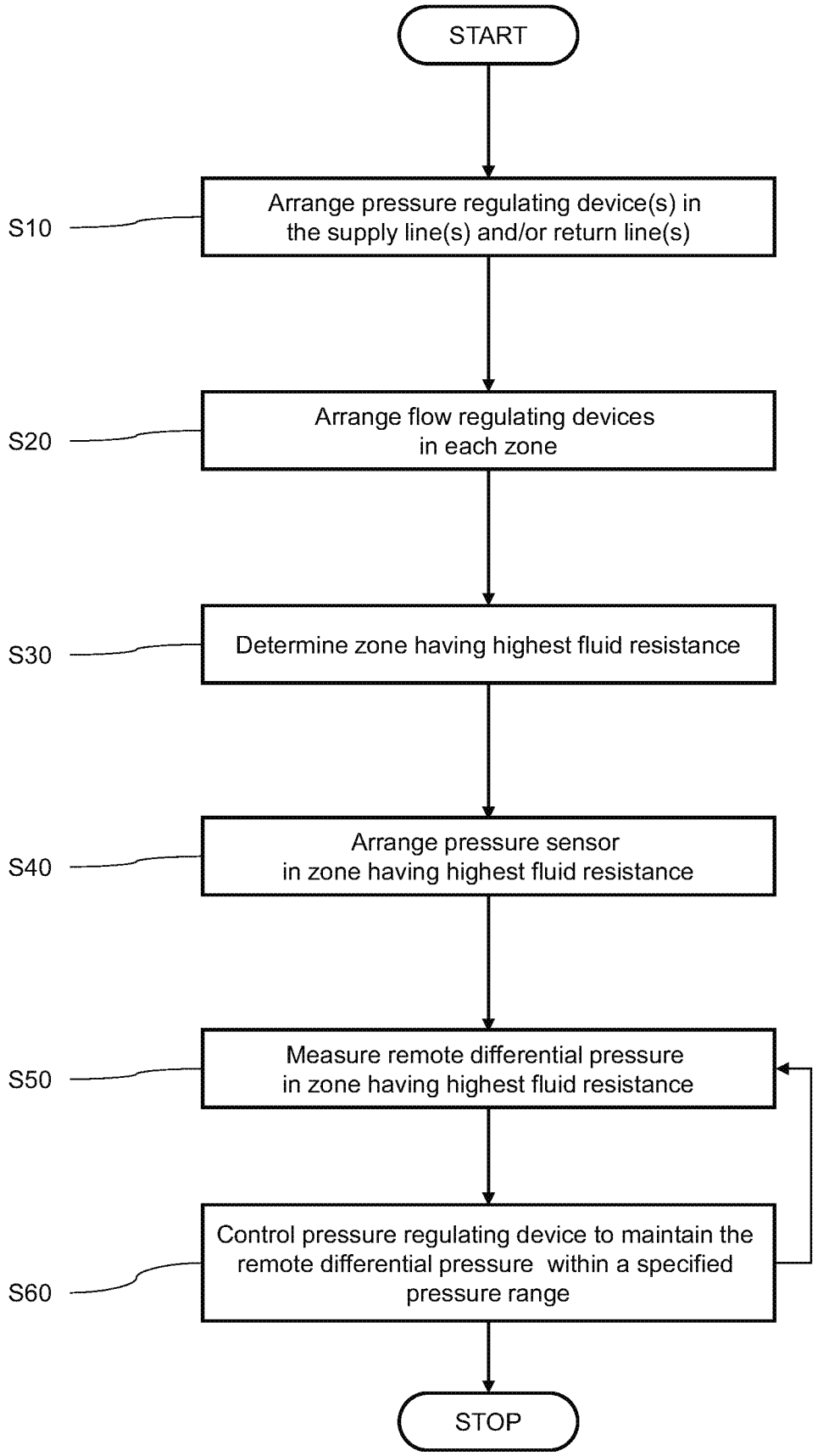
FIG. 3: a flowchart depicting steps of a first embodiment of a method of controlling an HVAC system comprising a fluid transportation network according to the present disclosure.

Turning now to FIG. 3, steps of a first embodiment of a method of controlling an HVAC system 1 comprising a fluid transportation network 100 according to the present disclosure shall be described. In a first step S10 a pressure regulating device PR, $PR_{a\text{-}z}$ is arranged in the supply lines LS, $LS_{a\text{-}z}$ and/or respective return lines LR, $LR_{a\text{-}z}$ of each of the network sections F, $F_{a\text{-}z}$. In particular, the pressure regulating device PR, $PR_{a\text{-}z}$ comprises a control valve or a control damper for regulating the pressure in the supply lines LS, $LS_{a\text{-}z}$ and/or respective return lines LR, $LR_{a\text{-}z}$ by varying an opening of an orifice. Alternatively or additionally, the pressure regulating device PR, $PR_{a\text{-}z}$ comprises or is connectable to a fluid flow generator P, such as a pump or fan, the pressure regulating device PR, $PR_{a\text{-}z}$ being configured to regulate the pressure by adjustment of a pumping power of the pump or a fan speed of the fan.

In a step S20, flow regulating devices $PI_{1\text{-}n}$, $PI_{a\text{-}z,1\text{-}n}$ are arranged in the zones $Z_{1\text{-}n}$, $Z_{a\text{-}z.1\text{-}n}$ of the network sections F, $F_{a\text{-}z}$ configured and arranged to regulate the flow of a fluid through the respective zones $Z_{1\text{-}n}$, $Z_{a\text{-}z.1\text{-}n}$.

In a step S30, the fluid resistance of all zones $Z_{1\text{-}n}$, $Z_{a\text{-}z.1\text{-}n}$ are determined, either mathematically based on geometries of the respective zones $Z_{1\text{-}n}$, $Z_{a\text{-}z.1\text{-}n}$ and/or by setting the flow regulating devices $PI_{1\text{-}n}$, $PI_{a\text{-}z.1\text{-}n}$ to their respective fully open setting and measuring a zone pressure in each of the plurality of zones $Z_{1\text{-}n}$, $Z_{a\text{-}z.1\text{-}n}$ and/or by successively closing flow regulating devices $PI_{1-n}$, $PI_{a-z.1-n}$ in all but one selected zone $Z_{1-n}$, $Z_{a-z.1-n}$ to determine the fluid pressure in the selected zone.

In a step S40, a pressure sensor SP, $SP_{a-z}$, $SP_H$, $SP_C$ is arranged for measurement of the remote differential pressure $dp_{Rem}$, $dp_{Rem,a-z}$ in the first zone $Z_1=Z_{maxRes}$, $Z_{maxRes.a-z}$, the first zone $Z_{maxRes}$, $Z_{maxRes.a-z}$ having a highest fluid resistance amongst the plurality of zones $Z_{1-n}$, $Z_{a-z.1-n}$ within the respective network section F, $F_{a-z}$ of the one or more network sections F, $F_{a-z}$. The pressure sensor SP, $SP_{a-z}$, $SP_H$, $SP_C$ is arranged—in the first zone $Z_1$—downstream from the thermal energy exchanger $\mathbf{80}_1$ $\mathbf{80}_{a-z,1}$ to measure a differential pressure over the flow regulating device $PI_1$, $P_{a-z,1}$ (as described in FIG. 1) or arranged to measure a differential pressure between the zone supply line $ZLS_{1-n}$, $ZLS_{1-n,a-z}$ and the zone return line $ZLR_{1-n}$, $ZLR_{1-n,a-z}$ (as described in FIG. 2) of the respective zone $Z_{1-n}$, $Z_{1-n,a-z}$.

In a further step S50, a remote differential pressure of the fluid $dp_{Rem}$, $dp_{Rem.a-z}$ in the first zone $Z_1=Z_{maxRes}$, $Z_{maxRes.a-z}$ (having the highest fluid resistance of the plurality of zones $Z_{1-n}$, $Z_{1-n,a-z}$) is measured using the pressure sensor SP, $SP_{a-z}$, $SP_H$, $SP_C$.

Having measured the remote differential pressure $dp_{Rem}$, $dp_{Rem.a-z}$ in the first zone $Z_1=Z_{maxRes}$, $Z_{maxRes.a-z}$ (having the highest fluid resistance of the plurality of zones $Z_{1-n}$, $Z_{1-n,a-z}$), in a step S60, the pressure regulating device PR, $PR_{a-z}$ is then controlled, by the controller 20, to maintain the measured remote differential pressure $dp_{Rem}$, $dp_{Rem.a-z}$ within a specified differential pressure range, in particular above a specified minimum pressure, typically such as to reach or maintain specified differential pressure setpoint within the specified differential pressure range.

Figure 4:
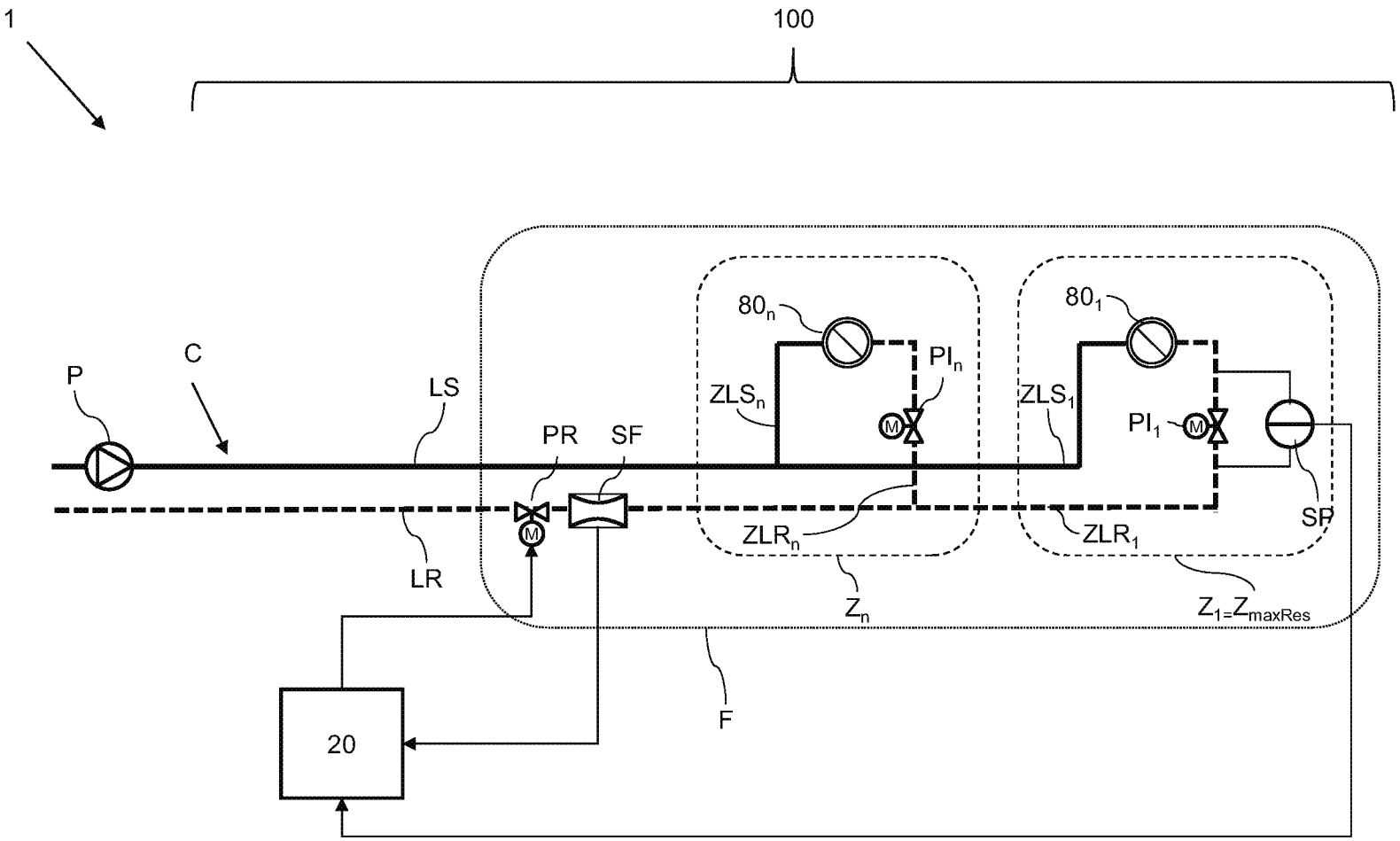
FIG. 4: a highly schematic block diagram of a further embodiment of an HVAC system according to the present disclosure, further comprising a flow sensor arranged in the return line of the network section.

FIG. 4 shows a highly schematic block diagram of a further embodiment of an HVAC system 1 according to the present disclosure, further comprising a flow sensor SF arranged in the return line LR of the network section F. It might also be arranged in the supply line LS or in both the supply line LS and the return line LR.

Figure 5:
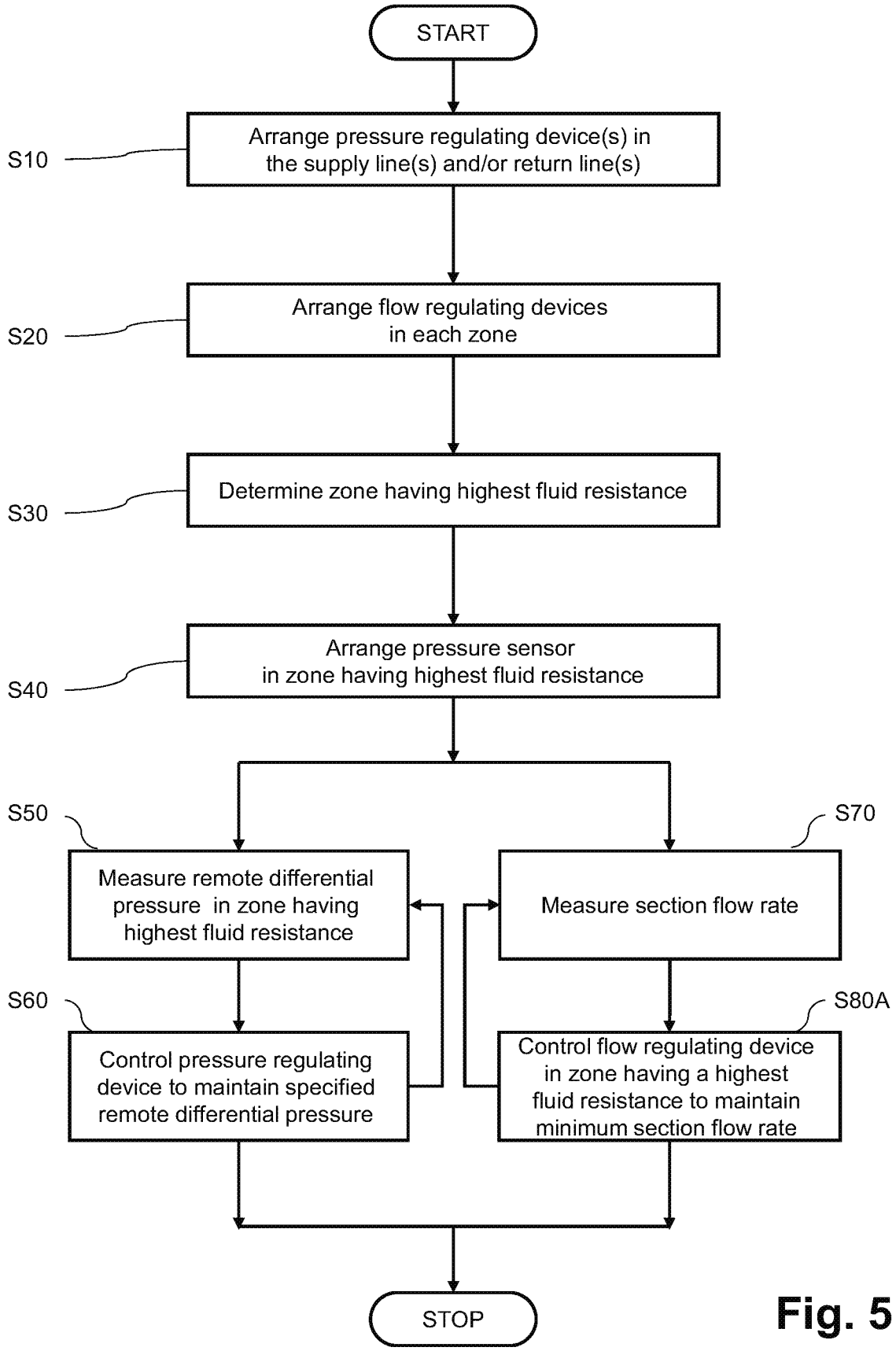
FIG. 5: a flowchart depicting steps of a further embodiment of a method of controlling an HVAC system comprising a fluid transportation network according to the present disclosure, further comprising measuring a section flow rate and maintaining the section flow rate above a minimum flow rate.

FIG. 5 shows a flowchart depicting steps of a further embodiment of a method of controlling an HVAC system 1 comprising a fluid transportation network 100 according to the present disclosure. In addition to the steps depicted on FIG. 3, in a step S70, a section flow rate $\phi S_{a-z}$ is measured in using a flow sensor SF, $SF_{a-z}$ arranged in the supply line LS, $LS_{a-z}$ and/or the return line LR, $LR_{a-z}$ of the network section F, $F_{a-z}$. Based on the measurement of the section flow rate $\phi S_{a-z}$, in a step S80A, the flow regulating device $PI_1$, $PI_{1,a-z}$ in the first zone $Z_1=Z_{maxRes}$, $Z_{maxRes.a-z}$ of highest fluid resistance amongst the plurality of zones $Z_{1-n}$, $Z_{1-n,\ a-z}$ is controlled—such as to maintain the section flow rate(s) $\phi S_{a-z}$ above a minimum flow rate.

FIG. 6 shows a highly schematic block diagram of a further embodiment of an HVAC system 2 according to the present disclosure, further comprising a bypass flow regulating device $PI_{Bypass}$ at a location of highest fluid resistance within each network section F. As shown on FIG. 6, the bypass flow regulating device $PI_{Bypass}$ is arranged at a location of highest fluid resistance within the network section F, even higher than the fluid resistance in any one of the flow regulated zone $Z_{1-n}$ (i.e. zones comprising a flow regulating device $PI_{1-n}$). The controller 20, controls the bypass flow regulating device $PI_{Bypass}$ such as to maintain the section flow rate $\phi S_{a-z}$ above a minimum flow rate. In other words, the bypass flow regulating device $PI_{Bypass}$ opened in order to ensure a minimum section flow rate $\phi S_{a-z}$ despite the flow regulating devices $PI_{1-n}$ of the zones $Z_{1-n}$ being closed.

Figure 7:
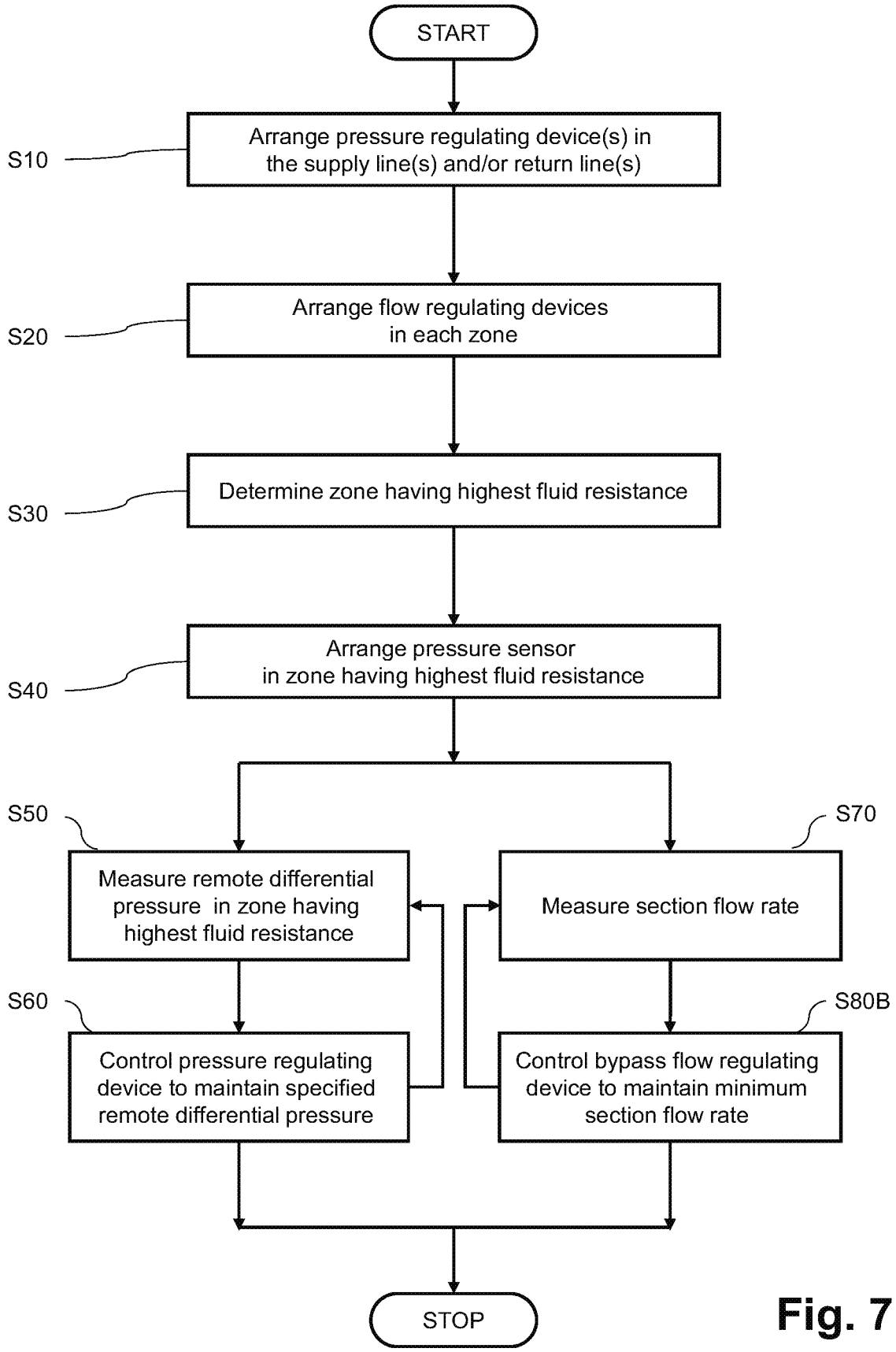
FIG. 7: a flowchart depicting steps of a further embodiment of a method of controlling an HVAC system comprising a fluid transportation network according to the present disclosure, further comprising controlling a bypass flow regulating device to maintain a minimum section flow rate.

FIG. 7 shows a flowchart depicting steps of a further embodiment of a method of controlling an HVAC system 1 comprising a fluid transportation network 100 according to the present disclosure. In addition to the steps described in relation with FIG. 3 and similar to FIG. 5, based on the measurement of the section flow rate $\phi S_{a-z}$ of step S70, in a step S80B the bypass flow regulating device $PI_{Bypass}$, $PI_{Bypass,\ a-z}$ is controlled such as to maintain the section flow rate $\phi S_{a-z}$ above a minimum flow rate, thereby ensuring that each zone $Z_{1-n}$, $Z_{1-n,a-z}$ operates in the specified differential pressure range and at the same time it ensured that a minimum flow of fluid flows through the network section F, $F_{a-z}$.

Figure 8:
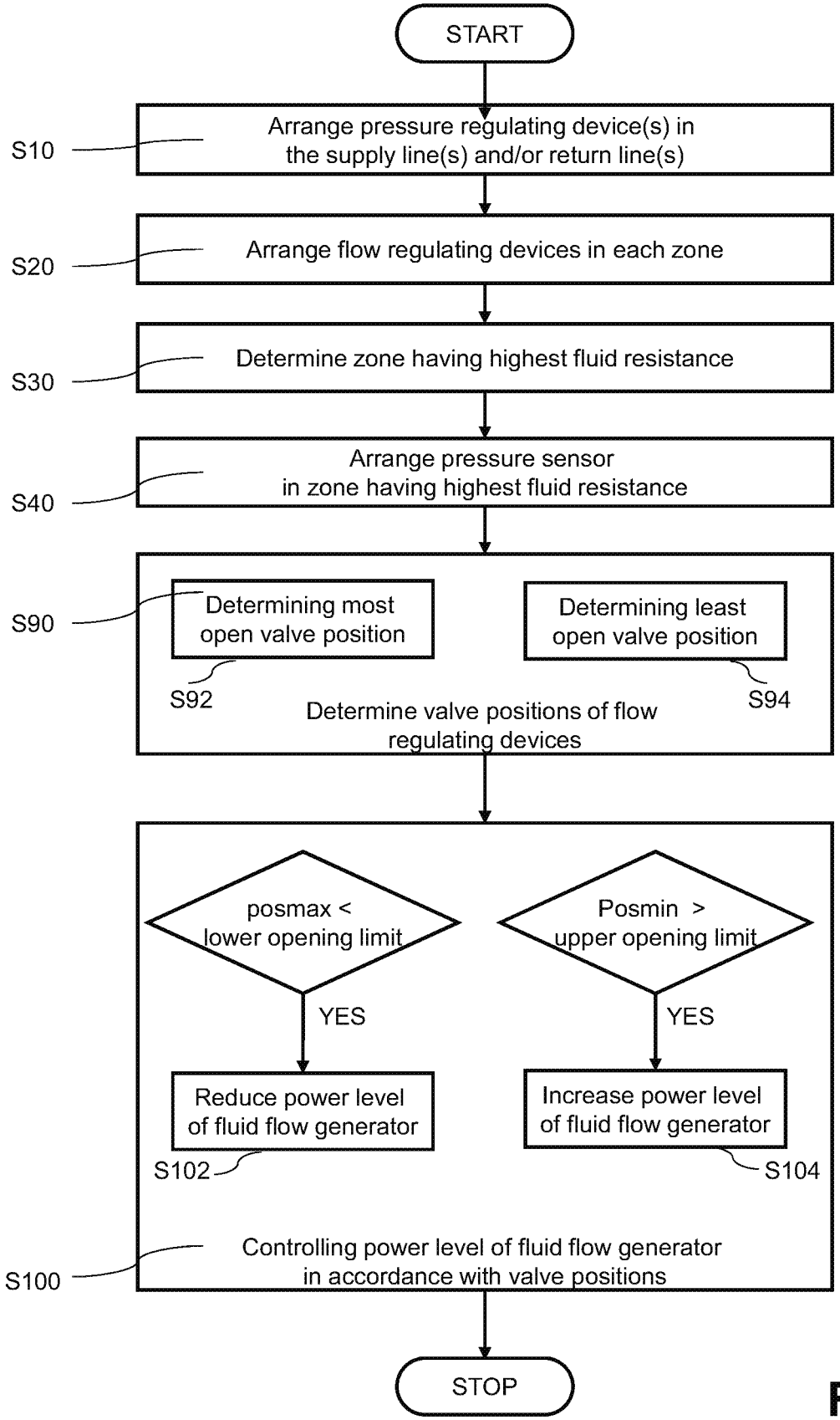
FIG. 8: a flowchart depicting steps of a further embodiment of a method of controlling an HVAC system comprising a fluid transportation network according to the present disclosure, further comprising steps for operating a fluid flow generator of the fluid transportation circuit(s) efficiently.

FIG. 8 shows a flowchart depicting steps of a further embodiment of a method of controlling an HVAC system 1 comprising a fluid transportation network 100 according to the present disclosure. In addition to steps S10 to S40 also depicted in FIG. 3, FIG. 8 further comprises steps for operating a fluid flow generator P of the fluid transportation circuit(s) C, $C_{a-z}$ efficiently. In a step S90, current valve (or damper) positions $pos_{1-n}$ of the flow regulating device $PI_{1-n}$, $PI_{a-z,1-n}$ of each of the zones $Z_{1-n}$, $Z_{1-n,\ a-z}$ is determined, the current positions $pos_{1-n}$ being indicative of opening of the respective flow regulating device $PI_{1-n}$, $PI_{a-z,1-n}$. In a first substep S92 of step S90, a currently most open position $pos_{max}$ amongst the positions $pos_{1-n}$ of all of the flow regulating devices $PI_{1-n}$ of each of the zones $Z_{1-n}$ is determined. In a second alternative or additional substep S94 of step S90, a currently least open position $pos_{min}$ amongst the current positions $pos_{1-n}$ of all of the flow regulating devices $PI_{1-n}$ of each of the zones $Z_{1-n}$ is determined.

Thereafter, in a step S100, a power level of fluid flow generator(s) P—such as a pumping power of a pump of the fluid transportation circuit C, $C_{a-z}$—is controlled in accordance with the current positions $pos_{1-n}$. In a substep S202 of step S100, the power level of the fluid flow generator(s) P, $P_{a-z}$ is reduced if the currently most open position $pos_{max}$ is below a lower opening limit. In an alternative or additional substep S204 of step S100, the power level of the fluid flow generator(s) P is increased if the currently least open position $pos_{min}$ exceeds an upper opening limit.

Figure 9:
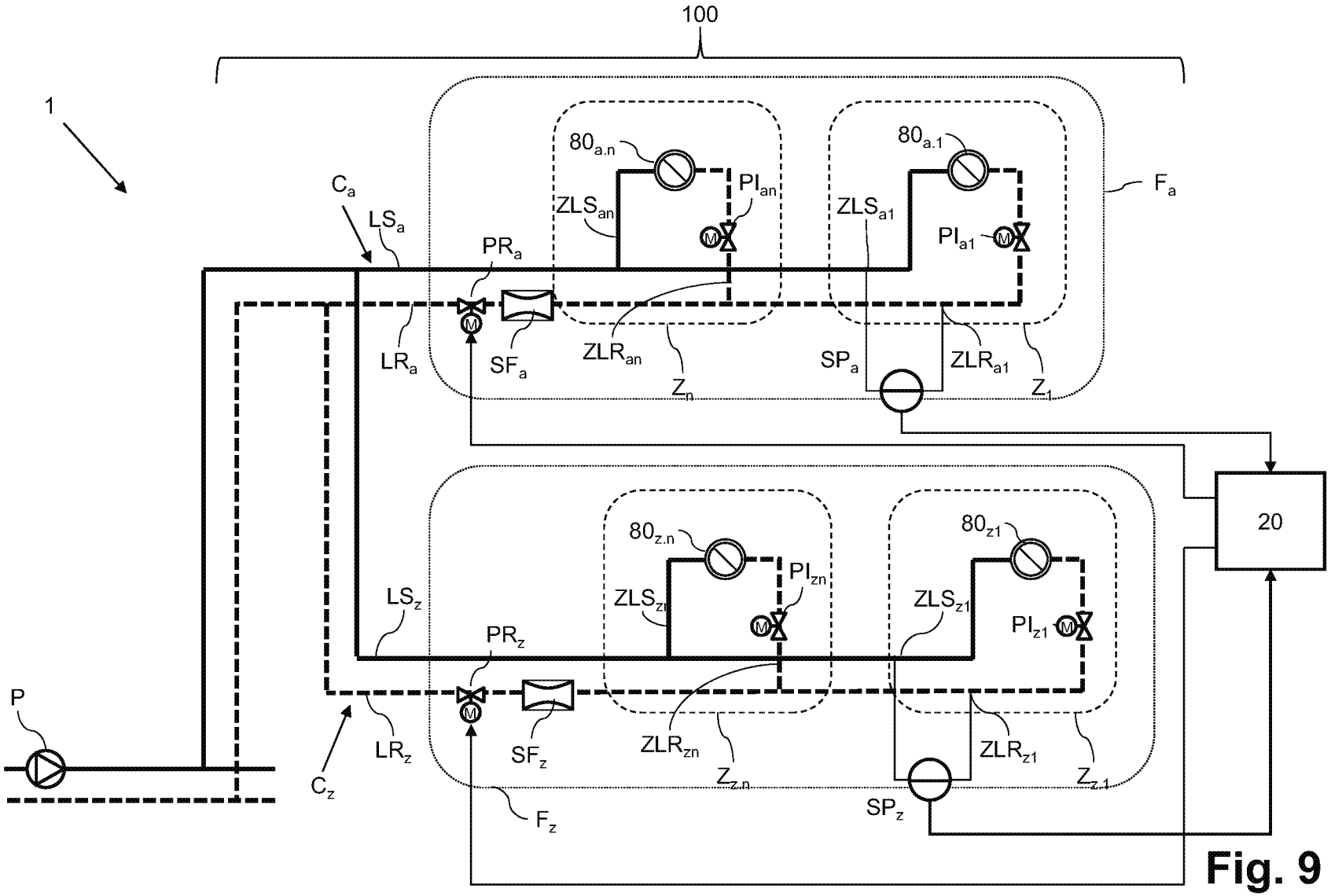
FIG. 9: a highly schematic block diagram of a further embodiment of an HVAC system according to the present disclosure, comprising a plurality of network sections, each network section being connected to a fluid transportation circuit through respective supply line(s) and return line(s), each network section comprising a plurality of parallel zones.

FIG. 9 shows a highly schematic block diagram of a further embodiment of an HVAC system 1 according to the present disclosure. The fluid transportation network 100 of the embodiment shown in FIG. 9 comprises a plurality of network sections $F_{1-n}$ each connected to a fluid transportation circuit $C_{a-z}$ through a supply line $LS_{a-z}$ and a return line $LR_{a-z}$. Each network section $F_{a-z}$ comprises a plurality of parallel zones $Z_{a-z.1-n}$. Each of the zones $Z_{a-z.1-n}$ comprises one or more thermal energy exchangers $\mathbf{80}_{a-z,1-n}$, e.g. heat exchangers for heating the zone $Z_{a-z.1-n}$ or chillers for cooling the zone $Z_{a-z.1-n}$. Furthermore, pressure regulating devices $PR_{a-z}$ are arranged in the return lines $LR_{a-z}$ of each network section $F_{a-z}$. In order to be able to independently regulate the flow rate $\phi_{1-n}$, $\phi_{a-z.1-n}$ of the fluid in the zones $Z_{a-z.1-n}$, flow regulating devices $PI_{a-z.1-n}$ are arranged in the zones $Z_{a-z.1-n}$. The HVAC system 1 further comprises pressure sensors $SP_{a-z}$ configured and arranged for measurement of the remote differential pressures $dp_{Rem,a-z}$ in the first zones $Z_{maxRes,\ a-z}$, the first zones $Z_{maxRes,\ a-z}$ each having a highest fluid resistance amongst the plurality of zones $Z_{a-z.1-n}$ within the respective network section $F_{a-z}$. Furthermore, flow sensors $SF_{a-z}$ are arranged in the return lines $LR_{a-z}$ of each network section $F_{a-z}$.

Figure 10A:
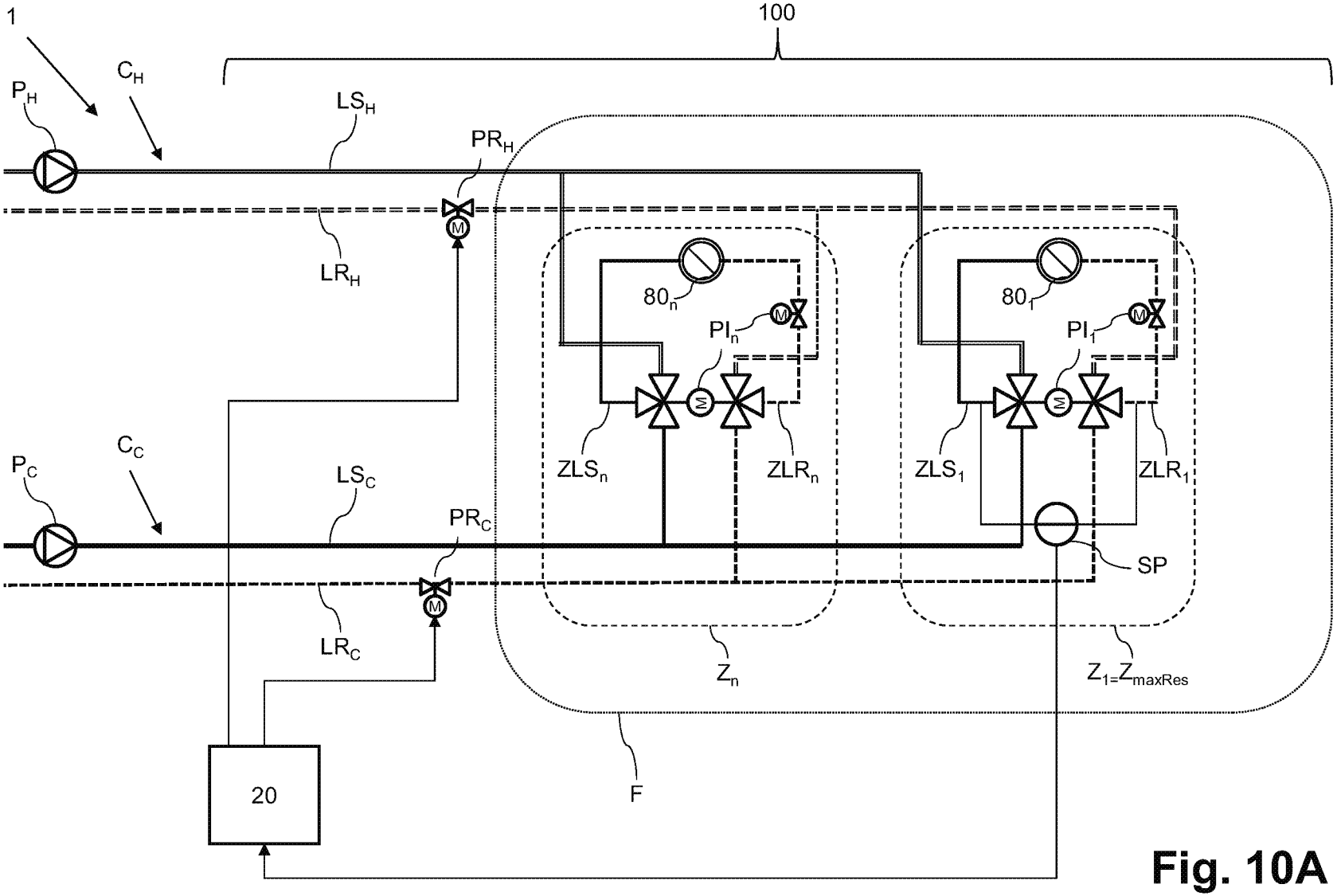
FIG. 10A: a highly schematic block diagram of a further embodiment of an HVAC system according to the present disclosure, comprising a plurality of fluid transportation circuits within a network section.
Figure 10B:
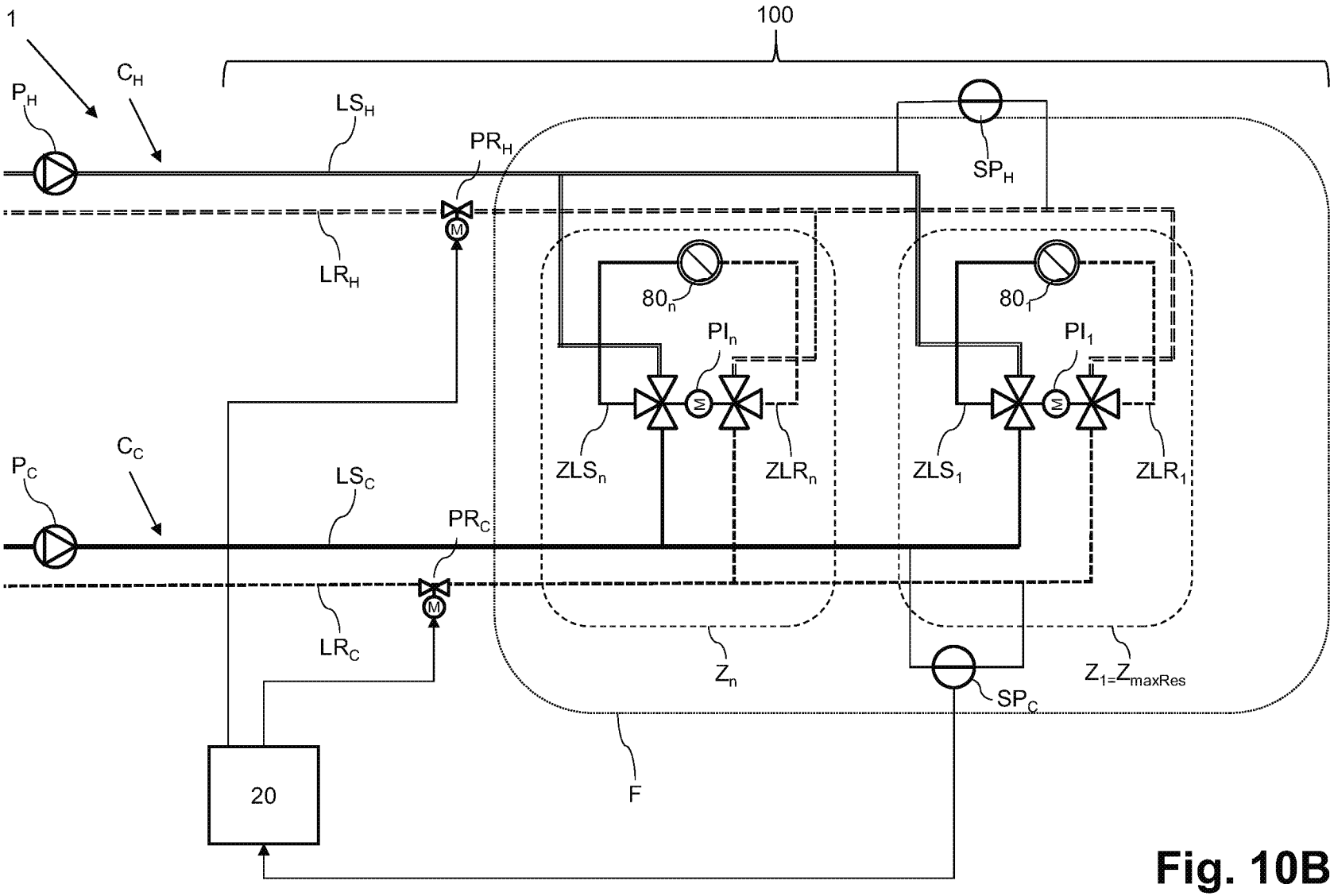
FIG. 10B: a highly schematic block diagram of a further embodiment of an HVAC system according to the present disclosure, comprising a plurality of fluid transportation circuits within a network section.

FIGS. 10A and 10B show highly schematic block diagrams of further embodiments of an HVAC system 1 according to the present disclosure, comprising a plurality of fluid transportation circuits $C_H$, $C_C$ within one network section F.

In order to allow a zone $Z_{1-n}$ to be alternatively coupled to two fluid transportation circuits $C_H$, $C_C$, such as a first fluid transportation circuit $C_H$ for supplying thermal energy (heating) or to a second fluid transportation circuit $C_C$ for extracting thermal energy (cooling), the flow regulating device(s) $PI_{1-n}$ comprises a six-way valve(s). In FIGS. 10A and 10B, the first fluid transportation circuit $C_H$ is depicted with double lines, while the second fluid transportation circuit $C_C$ is depicted with single lines. The zone supply and return lines $ZLS_n$ and $ZLR_n$ are depicted in single lines as well, but are part of both of the alternative fluid transportation circuits $C_H$, $C_C$.

In the embodiments shown on FIGS. 10A and 10B, the six-way valve(s) are provided in addition to the flow regulating valves of the flow regulating devices $PI_{1-n}$, which are configured and controlled for regulating the flow rate $\phi_{1-n}$ of the fluid.

In an alternative embodiment—shown on FIG. 10B—the six-way valve(s) are provided as flow regulating devices $PI_{1-n}$, the six-way valves being configured to both regulate the flow rate $\phi_{1-n}$ of the fluid and to alternatively couple the zone $Z_{1-n}$ to the first fluid transportation circuit $C_H$ or to the second fluid transportation circuit $C_C$.

In the embodiment depicted on FIG. 10B, a pressure sensor $SP_H$ is arranged for measurement of the remote differential pressure $dp_{Rem}$, $dp_{Rem.a-z}$ over the first zone $Z_{maxRes}$, $Z_{maxRes,a-z}$ when connected to the first fluid transportation circuit $C_H$ and a second pressure sensor $SP_C$ is arranged for measurement of the remote differential pressure $dp_{Rem}$, $dp_{Rem.a-z}$ over the first zone $Z_{maxRes}$, $Z_{maxRes,a-z}$ when connected to the second fluid transportation circuit $C_C$.

Figure 11:
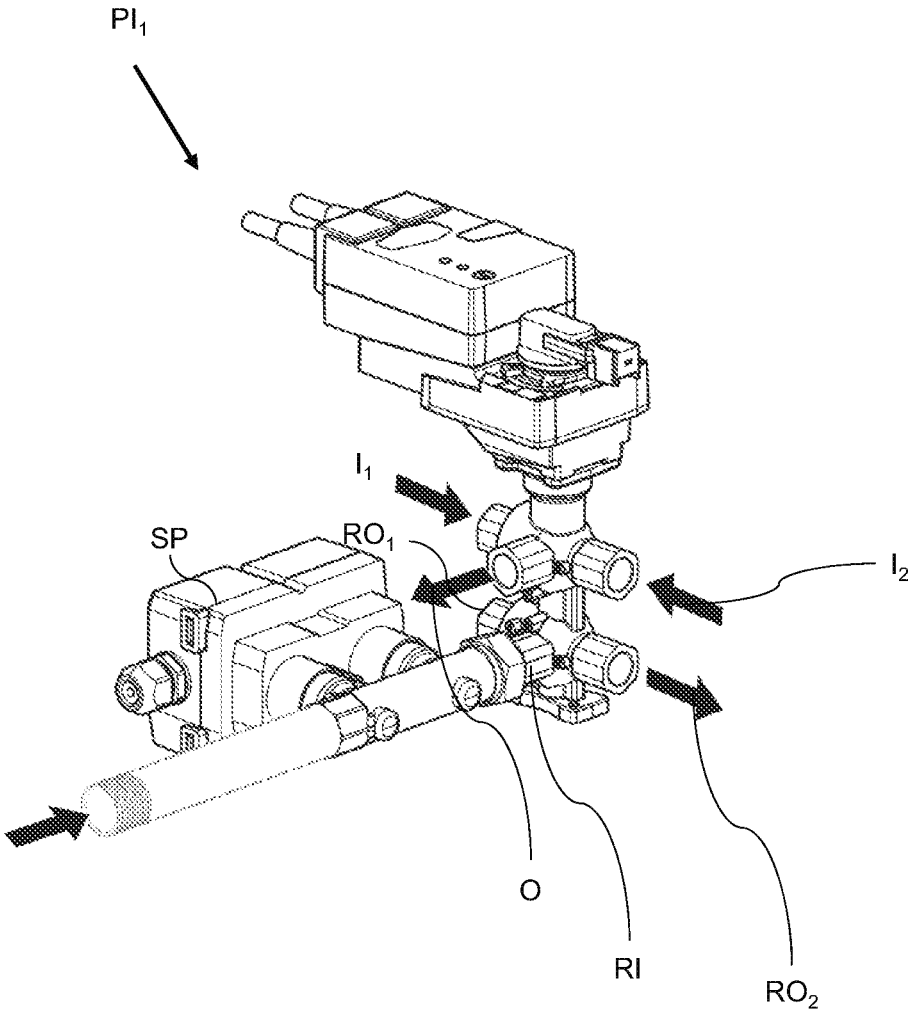
FIG. 11: a perspective view of an embodiment of a flow regulating device comprising a six-way valve.

As shown in FIG. 11, the six-way valves $PI_{1-n}$ each comprise a first fluid input port $I_1$, a second fluid input port $I_2$, a fluid output port O, a fluid return input port RI, a first fluid return output port $RO_1$ and a second fluid return output port $RO_2$. The first fluid input port $I_1$ and the first fluid return output port $RO_1$ are fluidically connected to a supply line $LS_H$ respectively a return line $LR_H$ of the (first) fluid transportation circuit $C_H$, while the second fluid input port $I_2$ and the second fluid return output port $RO_2$ are fluidically connected to a second supply line $LS_C$ respectively a second return line $LR_C$ of the second transportation circuit $C_C$. The fluid output port O and the fluid return input port RI are fluidically connected with the heat exchanger $\mathbf{80}_{1-n}$.

REFERENCE LIST fluid transportation network 100
network sections (of fluid transportation network) F, $F_{a-z}$
fluid transportation circuit C, $C_{a-z}$, $C_H$, $C_C$
supply line (of fluid transportation circuit) LS, $LS_{a-z}$
return line (of fluid transportation circuit) LR, $LR_{a-z}$
parallel zones (of network section(s)) $Z_{1-n}$, $Z_{a-z,1-n}$
zone supply line $ZLS_{1-n}$, $ZLS_{a-z.1-n}$
zone return line $ZLR_{1-n}$, $ZLR_{a-z.1-n}$
first zone (with highest fluid resistance) $Z_{maxRes}$, $Z_{maxRes,a-z}$
thermal energy exchanger $\mathbf{80}_{1-n}$, $\mathbf{80}_{a-z,1-n}$
flow regulating device $PI_{1-n}$, $PI_{a-z.1-n}$
pressure regulating device PR, $PR_{a-z}$
remote differential pressure $dp_{Rem}$, $dp_{Rem.a-z}$
controller 20
pressure sensor SP, $SP_{a-z}$, $SP_H$, $SP_C$
section flow sensor SF, $SF_{a-z}$
fluid flow generator P

The invention claimed is:

1. A method of controlling a Heating, Ventilating and Air Conditioning (HVAC) system comprising a fluid transportation network that comprises one or more network sections, each network section being connected to a fluid transportation circuit through respective supply lines and return lines, each network section comprising a plurality of zones that are parallel, the method comprising:

arranging a pressure regulating device in the supply lines and/or respective return lines of the network sections;

arranging flow regulating devices in the zones of the network sections;

arranging a pressure sensor for measurement of a remote differential pressure in a first zone, the first zone having a highest fluid resistance among the plurality of zones within the respective network section of the one or more network sections;

measuring a remote differential pressure of the fluid in the first zone of the plurality of zones of each of the network sections; and controlling, by a controller, the pressure regulating devices of each network section to maintain the measured remote differential pressure within a specified differential pressure range.

2. The method according to claim 1, wherein one or more of the flow regulating devices are pressure-invariant regulating devices configured to implement the respective zones as pressure independent branches of the respective network section.

3. The method according to claim 2, further comprising:

determining a fluid resistance of each of plurality of zones within the respective network section; and determining the first zone with the highest fluid resistance amongst the plurality of zones within the respective network section based on the fluid resistance of each of plurality of zones.

4. The method according to claim 3, wherein determining a fluid resistance of each of the plurality of zones comprises one or more of:

calculating the fluid resistance of the zones mathematically based on their geometries;

setting one or more flow regulating devices arranged in one or more of the zones to their respective fully open setting and measuring a zone pressure in each of the plurality of zones for determining the first zone with highest fluid resistance amongst the plurality of zones within the respective network section; and/or successively closing the flow regulating devices in all but one selected zone of the plurality of zones of the network sections to determine a fluid pressure in the selected zone.

5. The method according to claim 2, wherein arranging pressure sensors for measurement of the remote differential pressure in the first zone comprises arranging the pressure sensors such as to measure a differential pressure between a zone supply line and a zone return line of the first zone.

6. The method according to claim 2, wherein arranging pressure sensors for measurement of the remote differential pressure in the first zone comprises arranging the pressure sensors such as to measure a differential pressure over the flow regulating device in the first zone.

7. The method according to claim 1, further comprising:

measuring section flow rates using section flow sensors arranged in the supply lines or respective return lines of one or more of the network sections; and controlling, by the controller, the flow regulating devices in the first zones—having a highest fluid resistance amongst the plurality of zones—such as to maintain the section flow rates above a minimum flow rate.

8. The method according to claim 1, further comprising:

measuring a section flow rate in the supply lines or respective return lines of each of the network sections using a section flow sensor arranged in the supply line and/or the return line of each of the network sections;

arranging a bypass flow regulating device at a location of highest fluid resistance within the respective network section; and controlling, by the controller, the bypass flow regulating device such as to maintain the section flow rate above a minimum flow rate.

9. The method according to claim 7, further comprising:

measuring a fluid temperature at the respective supply lines and/or return lines of each network section; and adjusting the minimum flow rate in accordance with the measured fluid temperature.

10. The method according to claim 5, further comprising compensating the specified differential pressure range by a pressure compensation value if a current position of the flow regulating device in the first zone is below a minimum opening threshold.

11. The method according to claim 10, further comprising determining the pressure compensation value based on an estimated differential pressure in a second zone having a second highest fluid resistance amongst the plurality of zones within the respective network section.

12. The method according to claim 1, further comprising:

determining current positions of the flow regulating device of each of the zones, the current positions being indicative of opening of the respective flow regulating device at a given time;

controlling, by the controller, a power level of fluid flow generators such as a pumping power of pumps of the fluid transportation circuit in accordance with the current positions.

13. The method according to claim 12, further comprising:

determining, from the current positions of the flow regulating devices of each of the zones, a currently most open position corresponding to the largest valve opening and/or currently least open position corresponding to the smallest valve opening amongst the positions of the flow regulating devices of each of the zones;

reducing the power level of the fluid flow generators if the most open position is below a lower opening limit and/or increasing the power level of the fluid flow generator if the currently least open position exceeds an upper opening limit.

14. The method according to claim 13, further comprising:

arranging zone flow rate sensors in each of the zones of the network sections;

measuring an actual flow rate through the respective zone using the zone flow rate sensors;

disregarding, from determining the currently most open position, positions of the flow regulating devices arranged in zones where the actual flow rate is below a flow rate threshold.

15. The method according to claim 1, wherein one or more of the flow regulating devices are implemented as six-way valves configured to couple each zone alternatively to a first fluid transportation circuit or to a second fluid transportation circuit.

16. A Heating, Ventilating and Air Conditioning (HVAC) system comprising:

a fluid transportation network having one or more network sections, each network section being connected to a fluid transportation circuit through respective supply lines and return lines, each network section comprising a plurality of zones;

a flow regulating device arranged in each of the zones of the network sections;

a pressure regulating device arranged in the supply lines and/or respective return lines of each of the network sections;

a pressure sensor for measurement of a remote differential pressure arranged in a first zone, the first zone having a highest fluid resistance amongst the plurality of zones within the respective network section of the one or more network sections; and a controller, wherein the HVAC system is configured to control the pressure regulating devices of each network sections to maintain the remote differential pressure, measured by the pressure sensor in the first zone, within a specified differential pressure range.

* * * * *